United States Patent [19]

Mims

[11] Patent Number: 4,768,328

[45] Date of Patent: Sep. 6, 1988

[54] AUTOMATIC TRAY PACKER

[75] Inventor: Herman D. Mims, Lawndale, N.C.

[73] Assignee: Machine Builders and Design, Shelby, N.C.

[21] Appl. No.: 3,009

[22] Filed: Jan. 13, 1987

[51] Int. Cl.[4] ..... B65B 35/40; B65B 35/44

[52] U.S. Cl. ..... 53/532; 53/542; 53/544

[58] Field of Search ..... 53/544, 542, 443, 447, 53/532, 540, 473, 247

[56] References Cited

U.S. PATENT DOCUMENTS

| | | | |
|---|---|---|---|
| 3,170,559 | 2/1965 | Clements | 53/542 X |
| 3,500,984 | 3/1970 | Talbot | 53/542 |
| 3,822,528 | 7/1974 | Carlsson et al. | 53/542 |
| 3,899,069 | 8/1975 | Heinzer . | |
| 3,914,919 | 10/1975 | Boissy et al. | 53/544 X |
| 3,930,572 | 1/1976 | Fluck et al. . | |
| 4,176,993 | 12/1979 | Luginbuhl . | |
| 4,219,112 | 8/1980 | Loewenthal . | |
| 4,394,899 | 7/1983 | Fluck . | |
| 4,505,093 | 3/1985 | Johnson | 53/542 X |
| 4,539,795 | 9/1985 | Wilkinson | 53/544 X |
| 4,611,705 | 9/1986 | Fluck | 53/542 X |
| 4,641,489 | 2/1987 | Wood | 53/542 X |

FOREIGN PATENT DOCUMENTS

| | | | |
|---|---|---|---|
| 0077753 | 9/1982 | European Pat. Off. | 53/542 |
| 2800657 | 8/1978 | Fed. Rep. of Germany | 53/542 |

*Primary Examiner*—Horace M. Culver

*Attorney, Agent, or Firm*—Sughrue, Mion, Zinn, Macpeak, and Seas

[57] ABSTRACT

The invention relates to an automatic tray packer system including a station at which a serial stream of incoming articles are stacked, separated into groups and discharged to a transversely moving tray-type package. The tray packer includes a conveyor belt for transporting the articles, one by one, while they lie substantially in a first plane, and a nose roller for decelerating the articles transported by the conveyor belt. The articles pass over the nose roller and partially rotate and drop along a slide. A flipper mechanism further rotates the articles and propels them one by one against a stack of previously propelled articles. A separator member first defines a downstream end of the stack, and then moves via cams, along an endless closed path, to define the upstream end of the stack and a downstream end of a next stack. A backup member replaces the separator member at the upstream end of the stack. The separator and backup members then move, with the stack therebetween, to dispose the stack on a trapdoor mechanism, through which the stack is dropped onto a tray.

20 Claims, 6 Drawing Sheets

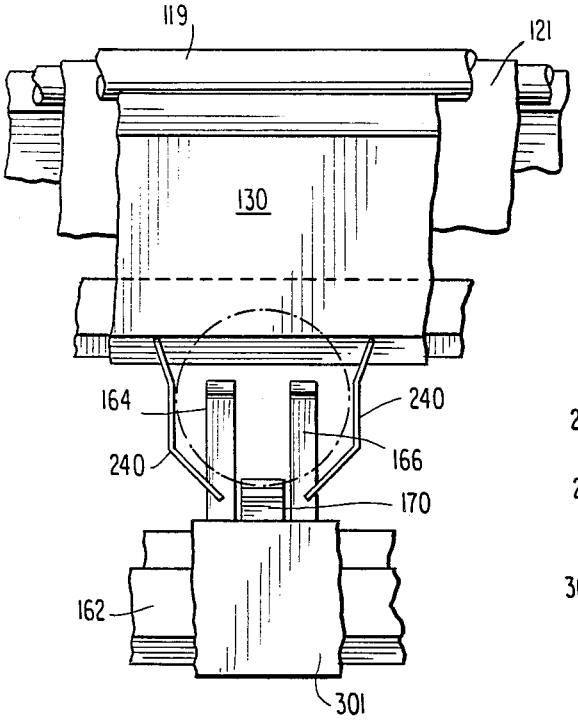
FIG. 4
FIG. 5
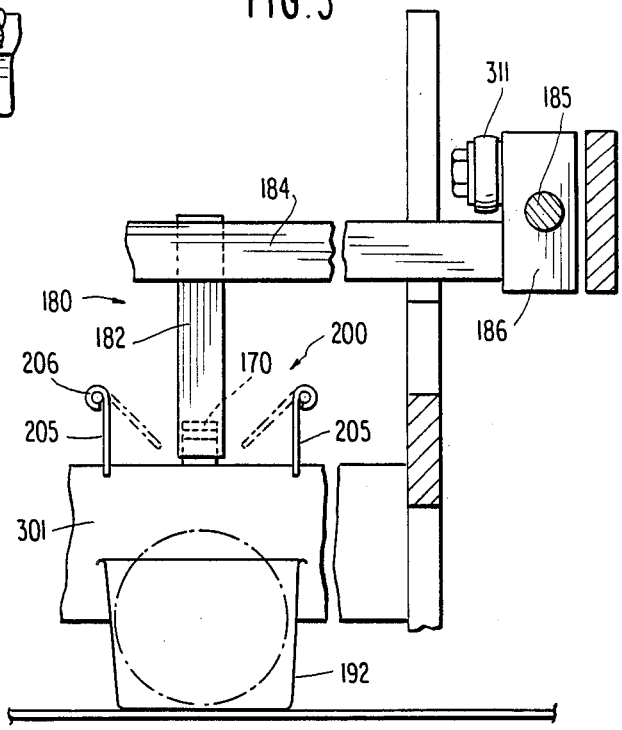
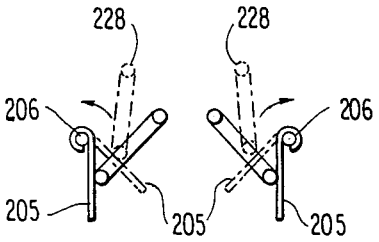
FIG. 6
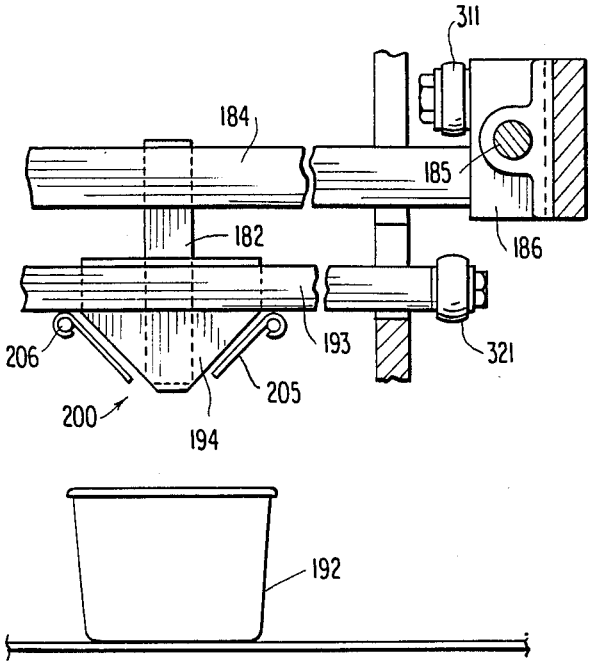
FIG. 7

FIG. 9
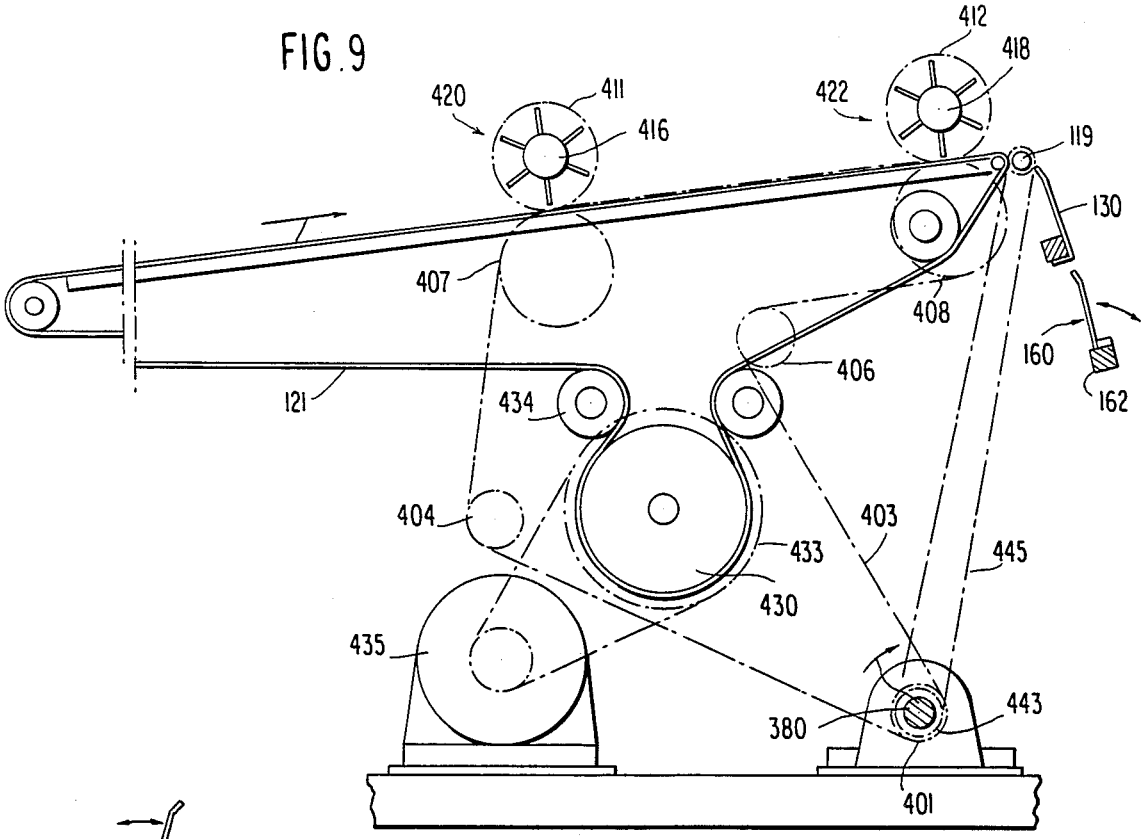
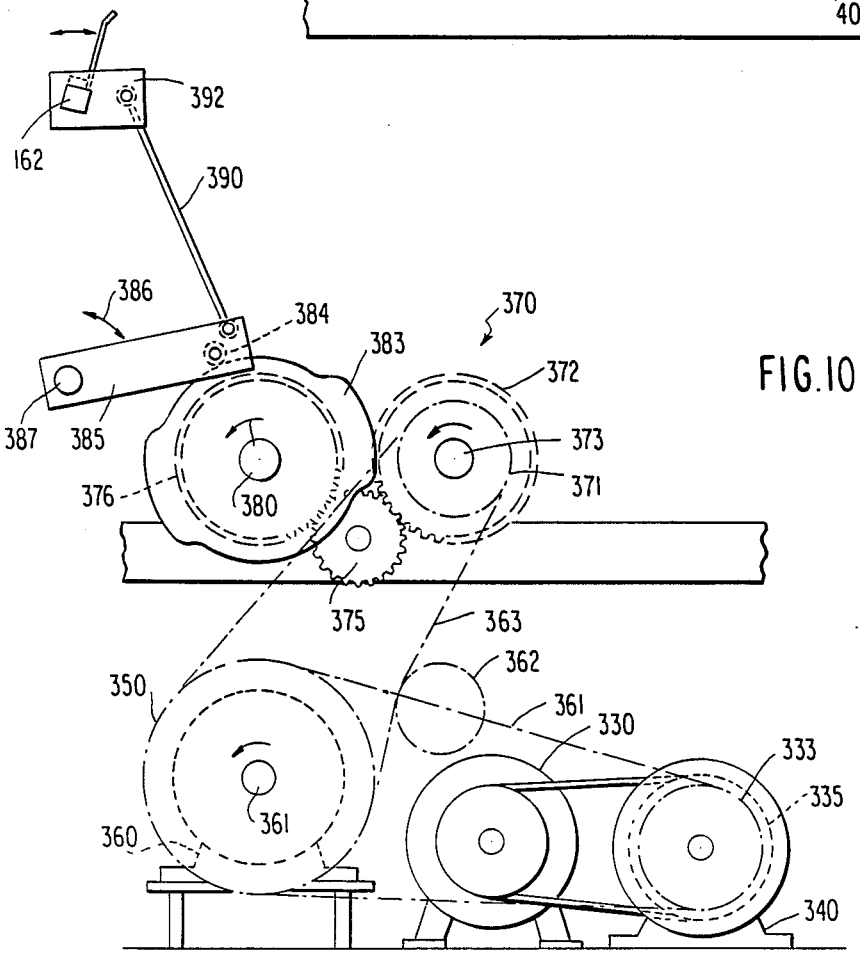
FIG. 10

AUTOMATIC TRAY PACKER

BACKGROUND AND SUMMARY OF THE INVENTION

The present invention relates in general to packaging machinery, and particularly to an apparatus which is capable of rapidly assimilating a group of substantially thin, flat, fragile articles into a stack which can then be emptied into a packing tray running transversely to the stacking direction. The invention is particularly adapted for use in a high production bakery, and has the object of arranging and spacing a plurality of baked articles on a conveyor belt, shifting the baked articles from the conveyor belt to a loading area where the baked articles are assmilated into stacks, and subsequently emptying the stacks of baked articles into a transversely moving packing tray.

BRIEF DESCRIPTION OF THE DRAWINGS

FIG. 4 is a lateral view taken along lines 4—4 of FIG. 1;

FIG. 5 is a lateral view taken along lines 5—5 of FIG. 1;

FIG. 6 is an operational diagram indicating actuated and non-actuated orientations of elements of the trapdoor mechanism of the invention;

FIG. 7 is a lateral view taken along lines 7—7 of FIG. 1;

FIG. 9 is a side view of the conveyor driving mechanism of the invention, and a part of the main drive train of the invention which drives the indexing mechanisms;

FIG. 10 is a side view of the main drive train of the invention;

DETAILED DESCRIPTION OF THE PREFERRED EMBODIMENTS

Figure 1:
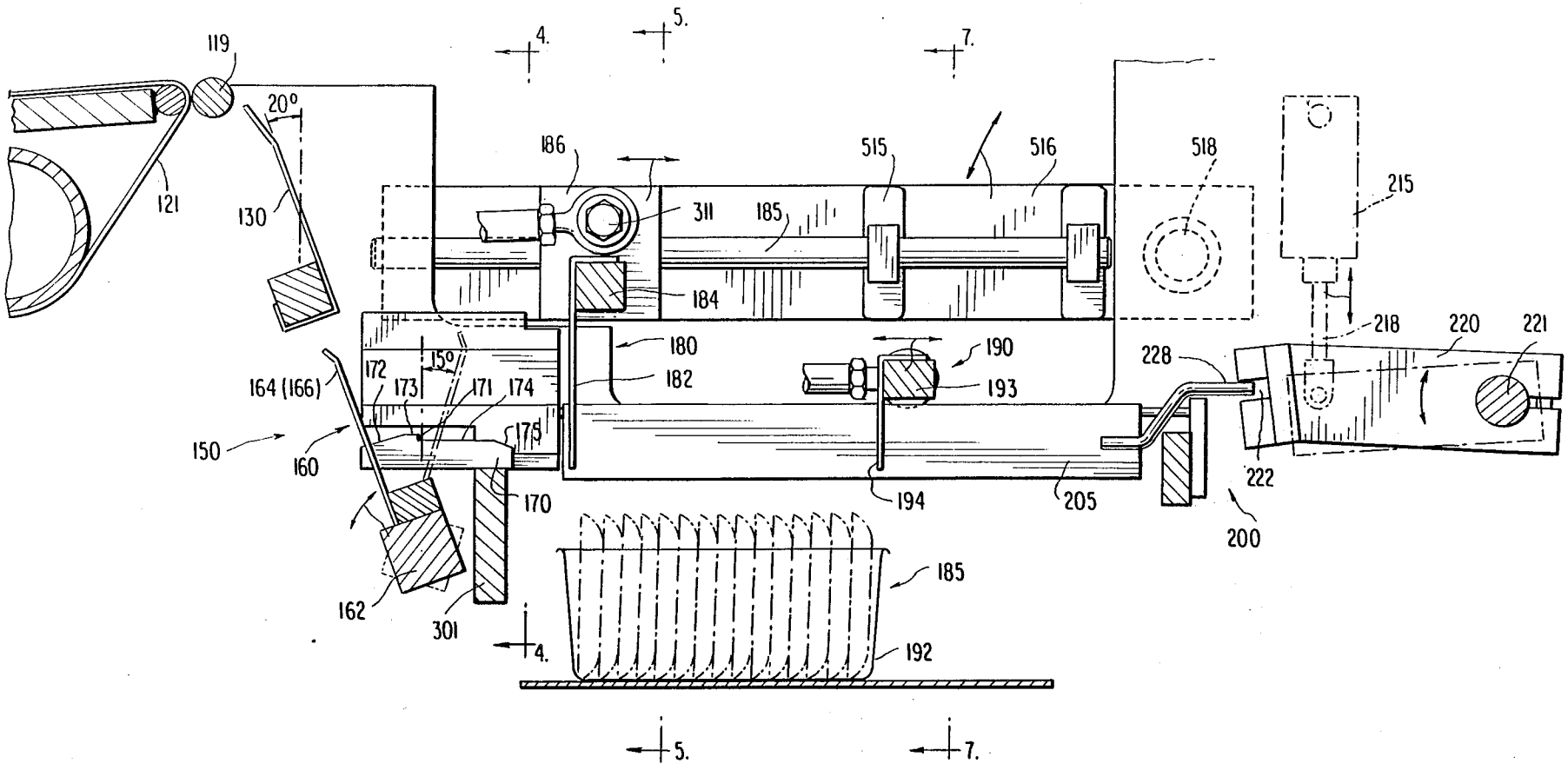
FIG. 1 is a side view of a stack assimilating and packaging section of the apparatus of the invention.

FIGS. 1 and 3A–3D particularly illustrate the apparatus and process by which a stream of articles are assimilated into a stack or slug, and are subsequently transferred to a package tray. Referring to FIG. 1, the articles are received by the apparatus by means of conveyor belt 121. At the end of the conveyor 121 is arranged a ½ inch-diameter nose roller 119 whose upper surface is tangent to the upper surface of the conveyor belt. The nose roller is driven separate from conveyor 121 (see FIG. 10) at a surface speed of approximately 60% of belt speed. The purpose of the nose roller is to decrease the velocity of the articles prior to their descent down a following slide member 130, and has been found to permit higher throughput rates as compared with the use of the conveyor 121 alone. Articles exiting the belt 121 and the nose roller 119 are received by the slide member 130 which includes a sliding surface arranged at an angle of approximately 20° from the vertical. While the angle of the slide 130 may vary with the speed of the conveyor 121, it has been found experimentally that an angle of 20° is suitable for a cookie throughput of 250 per minute.

The articles slide down the front face of slide 130 to be received in a transfer station 150. At the transfer station is located a bifurcated flipper member 160 supported by means of a reciprocatingly rotatable shaft 162. The flipper member includes a pair of metal fingers 164, 166 which are positioned on either side of a stop member 170 as shown in FIG. 4. The stop member 170 is adapted to be used as an abutment surface for the articles traveling down and exiting the slide 130. In particular, successive articles traveling down the slide 130 come into abutment with the front surface 172 of the stop member, where they temporarily come to rest as regards their motion in the vertical direction. The fingers 164, 166 subsequently travel to the right in FIG. 1 in an arc about the center of rotation of shaft 162, to a point where the fingers 164, 166 are approximately 15° past vertical as indicated in phantom lines in FIG. 1.

Figure 3C:
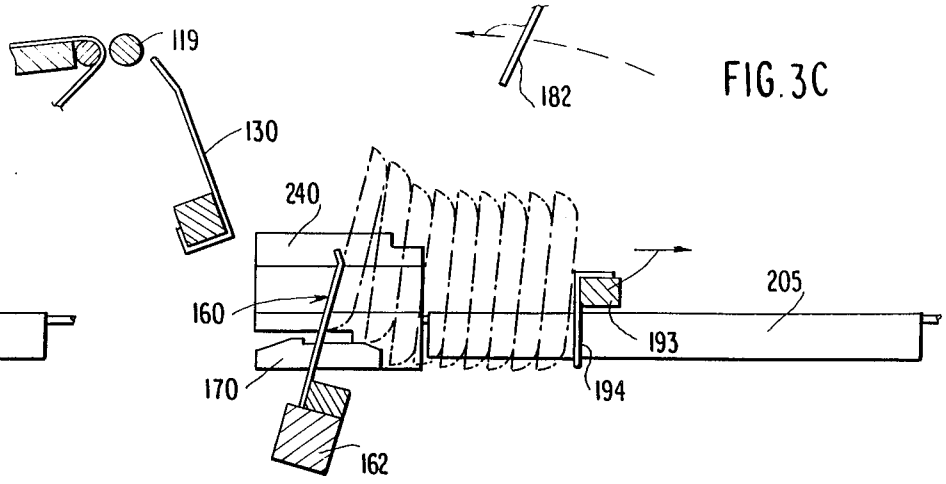
FIGS. 3A, 3B, 3C and 3D are representational side views of the apparatus shown in FIG. 1, together illustrating the sequence of operation of the various elements.
Figure 3D:
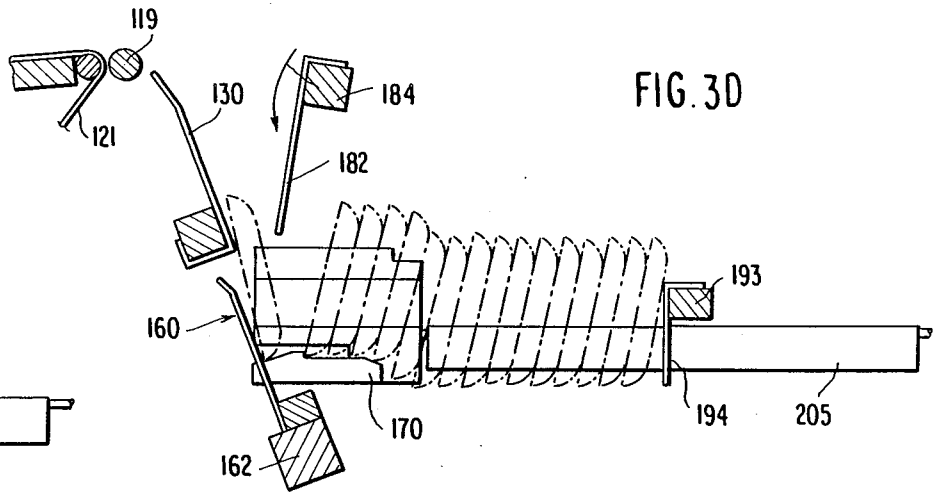
Figure 3A:
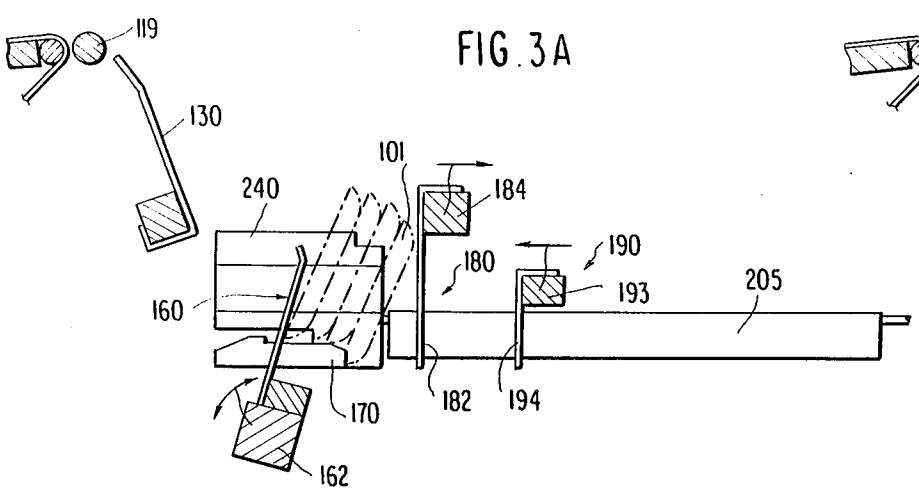
Figure 3B:
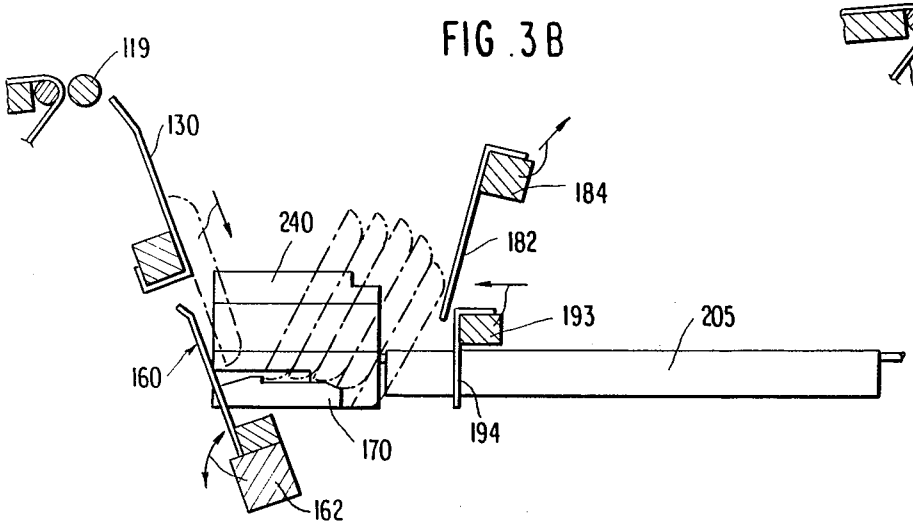

The manner of operation of the flipper mechanism is more clearly shown in FIGS. 3A–3D. As indicated in FIGS. 3B and 3D for example, an article sliding down the slide 130 intersects the path of flipper movement at a time when the flipper is substantially at the leftmost extreme f its reciprocating motion. The flipper begins to move to the right either at or shortly after the next incoming article has impacted against the abutment member 170 to halt its vertical downward movement. The flipper then engages the rear surface of the article and moves the article to the right as shown in the drawing figures. After the article has been moved to a point corresponding to the rightmost extreme of the reciprocating locus of the flipper (i.e., 15° past vertical), the flipper then returns leftwardly in order to receive another article. In the process of moving from the conveyor 121 to the output of the flipper, the articles are rotated, i.e., changed in orientation, through an angle of approximately 105°.

Figure 2:
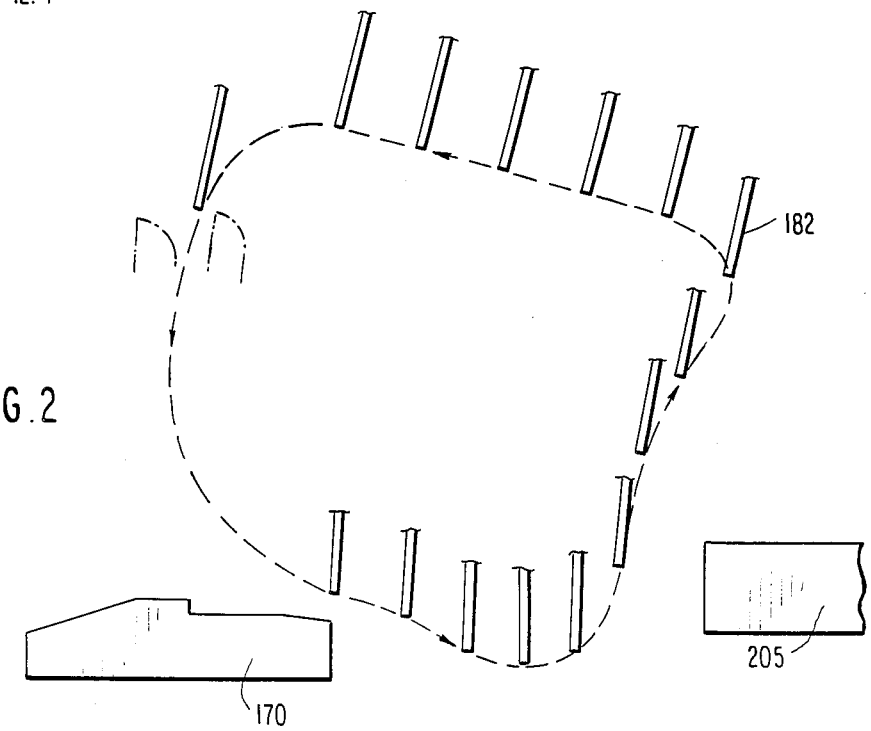
FIG. 2 is a tracing of the locus of motion of the separator member of FIG. 1, with a portion of the separator illustrated in a plurality of positions separated by equal intervals of time.

In the meantime, the first article 101 advanced by the flipper rests at its right-hand side upon a separator member 180 including a tongue portion 182 and a supporting shaft 184. By means of cam mechanisms and linkages described hereafter, the separator member is made to follow a complex locus of motion which is schematically illustrated in FIG. 2. One purpose of the separator member is to act as a temporary backstop for the accumulating articles forwarded by the flipper until a backup member 190 can advance to a position where it is capable of taking over performance of this function. The separator member 180 then travels in an arcuate path back to a position substantially opposite the flipper, where it is inserted between two adjacent articles in order to define the boundary between one stack or slug of articles and the next. As can be determined from FIG. 3D, the tongue portion 182 will be positioned just behind the last article 102 in the stack at the time when the first article **101*a*** of the next stack is to be forwarded by the flipper and supported on the backside of the tongue portion.

Referring specifically to FIGS. 1 and 3A–3D, FIG. 1 illustrates what will be designated as the "starting position" for purposes of description of the operable elements. In this position, a group of articles 185 has just been transferred from the stacking apparatus into a tray 192 by means of a "trap-door" mechanism 200 which will be described later. At this time, the separator 180 and the backup member 190 are still positioned such that they are in alignment with the front and rear ends of the stack of articles which has just been dropped. The backup member 190 is at substantially the rightmost extreme of its locus of motion at this point.

Although not apparent from FIG. 1, the separator member 180 in the illustrated position serves two functions at this time. Namely, just before the group of articles 185 was dropped to the position shown in FIG. 2, the separator 180 served to define the position of the leftmost end of the stack 185. At the same time, the separator 180 serves as a backing member for articles which have in the meantime been accumulating on its backside due to the continuous action of the flipper 150. For purposes of clarity, the articles behind the separator member 180 have not been illustrated in FIG. 1.

FIG. 3A shows the position of the elements at a time shortly after that shown in FIG. 1. As compared with FIG. 1, the separator member 180 has moved slightly to the right, in order to accommodate an increasing number of incoming articles forwarded by the flipper 150. On the other hand, the backup member 190 has moved to the left toward the position at which it will replace the separator member 180 in performing the backup function. Also, between time t (FIG. 1) and time t+1 (FIG. 3A) the above mentioned "trap-door" mechanism has closed, so that sides 205 thereof form an essentially "V" shaped channel which will support the accumulating stack of articles. Up through the time shown in FIG. 3A, the articles have been laterally supported by a pair of wing members 240, best seen in FIG. 4, which together form a chute leading to the channel formed by surfaces 205.

As shown in FIG. 3B, approximately 5 articles are disposed behind the separator 180 by the time that the backing plate 190 has reached a position permitting its substitution for the separator member 180 in this example. FIG. 3B shows the disposition of the elements at time t+2, just prior to the departure of the separator member 180. As is apparent from comparing FIGS. 3A and 3B, the separator 180 has already begun to tilt in a clockwise manner and rise vertically from the position shown in FIG. 3A. The raising of the separator is effected by means of the upward pivoting of lever 516 (FIG. 1) as described in greater detail below. In FIG. 3B, the backstop 190 is almost in its most extreme leftward position.

FIG. 3C shows the arrangement of the various elements at a somewhat later time. Here, as the flipper continues to deliver additional articles to the right as they arrive at the abutment member 170, the backing member 190 moves rightwardly in order to accommodate the increasing stack of articles. The speed of member 190 is set at this time so as to be equal to the speed at which the length of the article stack increases. Meanwhile, the separator member 180 is reversed in direction after being raised, so as to return to a position at the back of the growing article stack.

At the position shown in FIG. 3D, the separator has moved into a position substantially opposite the flipper member 150 and has begun its rapid descent into a position between the last article in the accumulated stack and the next article which is just about to be engaged by the flipper member 150. The motion of the separator member 180 is greatly accelerated during this movement, as it is necessary to move the separator member to a position substantially behind the preceding article prior to the next reciprocaton of the flipper member, which may be delivering up to four or more articles per second to the stack.

Once the separator member has engaged the rearmost article in the accumulated stack, the separator member and the backing member both proceed in a rightward direction at the same linear speed, thus transporting the stack from the position shown in FIG. 3D to a position such that the entire stack is supported by means of the trap-door mechanism 200. The separator member 180 and the backing member 190 are substantially in the position shown in FIG. 1 at this time. Just before operation of the trap-door mechanism to drop the cookies into a cell of adjacent tray 192, the backing member 190 may be made to momentarily move slightly leftwardly in FIG. 1, in order to "nudge" the stack of articles closer together so as to substantially eliminate gaps therebetween and shift the articles into a fully upright position. Normally, the articles are slightly tilted toward the backing member 190, as illustrated in FIG. 3D, for example.

The construction and operation of the trap-door mechanism may be seen from FIGS. 1, 5, 6 and 7. As shown in FIG. 5, the trap-door mechanism includes the pair of plates 205 which together form a substantially "V" shaped support channel for the accumulating stack of articles. The normal position of the plates 205 is illustrated in dotted outline in FIG. 5, while the release position is illustrated in solid lines. When the plates 205 are moved to the release position, the stack of articles simply falls into the tray 192 under its own weight.

The manner of actuation of the trap-door is substantially illustrated in FIGS. 1 and 6. As shown in FIG. 1, an air cylinder or similar actuator 215 includes a piston rod 218 which is reciprocally movable as indicated by the associated arrow. The piston rod 218 is connected in a suitable fashion to a pivotable actuating lever 220, which is reciprocally movable with shaft 221 as indicated by the associated arrow in FIG. 1. At the end of the lever 220 is provided a slot 222 in which is received the ends of a pair of actuating arms 228, each of which is securely affixed to its associated plate 205.

Actuation of the air cylinder 215 causes downward movement of the lever 220 which in turn moves the arms 228 from the position shown in dotted lines in FIG. 6 to the position shown in solid lines in the same figure. Concurrently, the plates 205 are rotated about their associated pins 206 so as to move the plates 205 to the discharge position.

Further details of the stop member 170 can be seen from FIG. 1. In particular, the stop member 170 includes an initial abutment surface 172 with which each successive article is engaged. The surface 172 is sloped such that it defines an angle of approximately 85° with the fingers 164, 166 of flipper member 160 when the same are at their rearward or leftmost position. The sloped portion 172 is followed by a backsliding preventing step 171 and a flat land portion 173, which is in turn followed by a further flat portion 174 which leads to the terminal sloped portion 175. As the articles leave the sloped portion 175, they become supported by the wing members 240, 240 at their bottoms as well as their sides, as can be seen from FIG. 4.

The flipper member 160 has an angular range of movement of approximately 30°, from about 15° left of vertical to 15° past vertical in FIG. 1. This range of movement is sufficient to clear the stop surface 172 for the approach of the next article, and to transport the rear of each article to a point approximately just past the first land surface 173 and the step 171.

FIGS. 4, 5 and 7 are each transverse views taken along the corresponding lines indicated in FIG. 1. FIG. 4 clearly illustrates the orientation of the conveyor 121, the nose roller 119, the slide member 130, the wings 240, 240, the flipper fingers 164, 166 and the stop member 170. The location of an incoming cookie as received by the stop block 170 is illustrated in dotted outline in FIG. 4. The shaft 162 for the flipper 160 is also seen in this figure, behind separation wall 301.

FIG. 5 shows the separator member 180, the trapdoor mechanism 200, and a receiving tray 192. As can be determined from comparing FIGS. 4 and 6, the tongue 182 of the separator member is arranged so as to fall between the fingers 164, 166 of the flipper member 160. In the position shown in FIG. 5, the separator tongue 182 is positioned just in front of the stop block 170, which is illustrated in dotted outline therebehind.

The separator tongue 182 is supported on shaft 184, which is integrally connected with blocks 186, one of which is shown in FIG. 5. Blocks 186 are slidable on shafts 185 by means of a linkage including connector 311, which will be described in more detail below.

FIG. 7 is a transverse view taken along lines 7—7 in FIG. 1. In this figure is illustrated the separator tongue 182, its shaft 184, the backing member 190 and its shaft 193, and a tray element 192. As is apparent from FIG. 7, the shape of the backup member 190 conforms substantially to the "V" shape defined by the sides 205 of the trap-door mechanism 200. In addition, the downward extension of the backup member 190 is substantially coextensive with that of separator tongue 182. The shaft 193 is driven by means of a linkage including right and left connectors 321, whose movement is controlled in a manner to be described below.

Although only single cell trays 192 are shown in FIGS. 5 and 7, it will be appreciated that trays having any number of cells may be employed according to the invention. Although not shown in the associated drawing figures, trays 192 are sequentially fed to the drop position via a transversely running conveyor whose speed is correlated to the timing of the trap-door mechanism 200.

FIGS. 8–12 illustrate the drive train and the linkages employed by the invention to attain the manner of operation described in the foregoing. Referring first to FIG. 10, a motor 330 supplies the driving power for all of the operating elements, excepting the conveyor run 121. The output of the motor 330 is coupled to the input of a first speed reducer 340 by means of a belt drive 333. The output sprocket 335 of the speed reducer 340 is coupled to the input sprocket 350 of a second speed reducer 360 by means of a chain drive 361. The output 361 of the second reducer 360 is used to drive control cams for the separator 180 and backup member 190, as described subsequently. The sprocket 350 is also coupled to the input of the flipper drive cam system 370 by means of a chain drive 363. Element 362 is a tension idler for the chain drive. Sprocket 371 of the flipper drive cam mechanism 370 is fixedly secured to a shaft 373, which in turn fixedly mounts a gear 372 which is in engagement with speed change gear 375. Torque is transferred via the gear 375 to a gear 376 provided on shaft 380. At one end of the shaft 380 is mounted a cam member 383 which serves to drive the flipper mechanism.

Particularly, the cam 383 is associated with a follower 384 which is rotatably supported by a pivotable lever 385. As the cam 383 is rotated via the shaft 380, the lever 385 will pivot in a reciprocating manner about shaft 387 as indicated by the arrow 386. Near the follower 384 is located one end of a rigid link 390 which is coupled at its other end to a lever 392 which is integral with at least one end of the shaft 162, which supports the flipper fingers 164, 166. As the lever 392 is reciprocatingly pivoted about the axis of shaft 162 via link 390, the flipper fingers are caused to undergo the reciprocating pivotal action described above.

Meanwhile, at the other end of shaft 380 from cam 383 is located a sprocket 401 shown in FIG. 9. (it should be borne in mind that FIG. 9 represents a view of the apparatus from the same orientation as is used in FIG. 1, while FIG. 10 is a view from the reverse side of the apparatus). Sprocket 401 is connected via chain drive 403 and intermediate idlers 404, 406 to a pair of driving gears 407, 408. The gears 407, 408 are meshingly engaged with gears 411, 412 provided on indexer shafts 416, 418, respectively. The shafts 416, 418 drive first and second rotary indexers 420, 422, respectively. The first rotary indexer 420 serves to accumulate and index the cookies traveling on conveyor belt 121 by releasing the cookies at a controlled timing. The second indexer 422 subsequently brings each cookie into precise registration. The details of rotary indexers 420, 422 are fully described in my U.S. Pat. No. 4,535,881, the disclosure of which is hereby incorporated by reference herein. It is possible and often preferably to employ only one rotary indexer of the type described. In such a case, the chain drive system can be simplified accordingly.

Shaft 380 also mounts a second sprocket 443 which, together with chain 445, drive nose roller 119. As noted previously, nose roller 119 rotates at a surface speed which is approximately 60% of belt speed.

Conveyor belt 121 is driven by means of a belt drive system including driving drum 430 and tension idlers 432, 434. The drum 430 is driven via variable speed motor 435 and chain drive 433.

Figure 8:
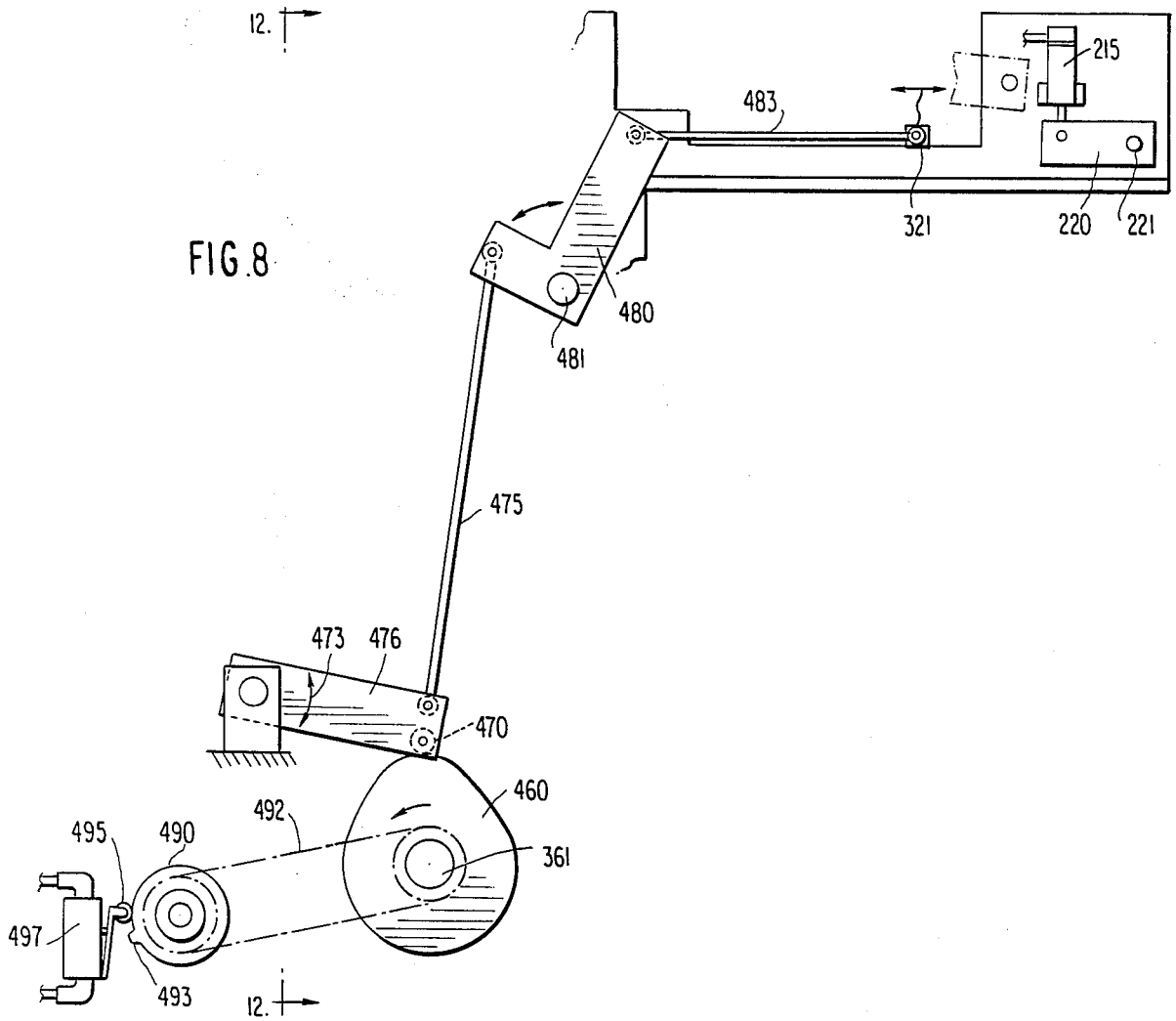
FIG. 8 is a simplified side view of the driving mechanism for the backup member of the invention.

As noted above, output shaft 361 of speed reducer 360 is coupled to a plurality of cam and follower mechanisms which define the movements of the separator 180 and backing member 190 via associated linkages. The drive system for the backup member is illustrated in FIG. 8. The output shaft 361 mounts three cams 460, 462, 464, of which cam 460 is associated with motion control of the backup 190 and is shown in FIG. 8. Cam 460 is associated with a follower 470 mounted for rotation on a pivotable lever 476. One end of a link 475 is connected to the lever 476 proximate the follower 470. As the cam 460 is rotated by shaft 361, the lever 476 is pivoted as indicated by arrow 473, to lift or lower the link 475.

The other end of link 475 is connected to one end of a bell crank member 480 which is pivotable about shaft 481. The other end of bell crank 480 is connected to the first ends of links 483 which are connected at their other ends via connectors 321 (FIG. 7) to the shaft 193 which supports the backup plate 194. By means of a guide (not shown), the shafts 193 is constrained for movement in the horizontal direction only. As is apparent from FIG. 8, each rotation of the shaft 361 effects one complete reciprocation of the backup member 190.

Also shown in FIG. 8 is a secondary cam 490 which is driven by shaft 361 via chain drive 492. The cam 490 includes a projection 493 which serves to actuate switch 497 via follower 495. The switch 497 controls the operation of air cylinder 215 shown in FIGS. 1 and 8, and thus controls the operation of the trap-door mechanism 200. As is evident from FIG. 8, the trap-door mechanism is operated once for each rotation of the cam 490. The cam 490 rotates at the same angular speed as shaft 361.

Figure 11:
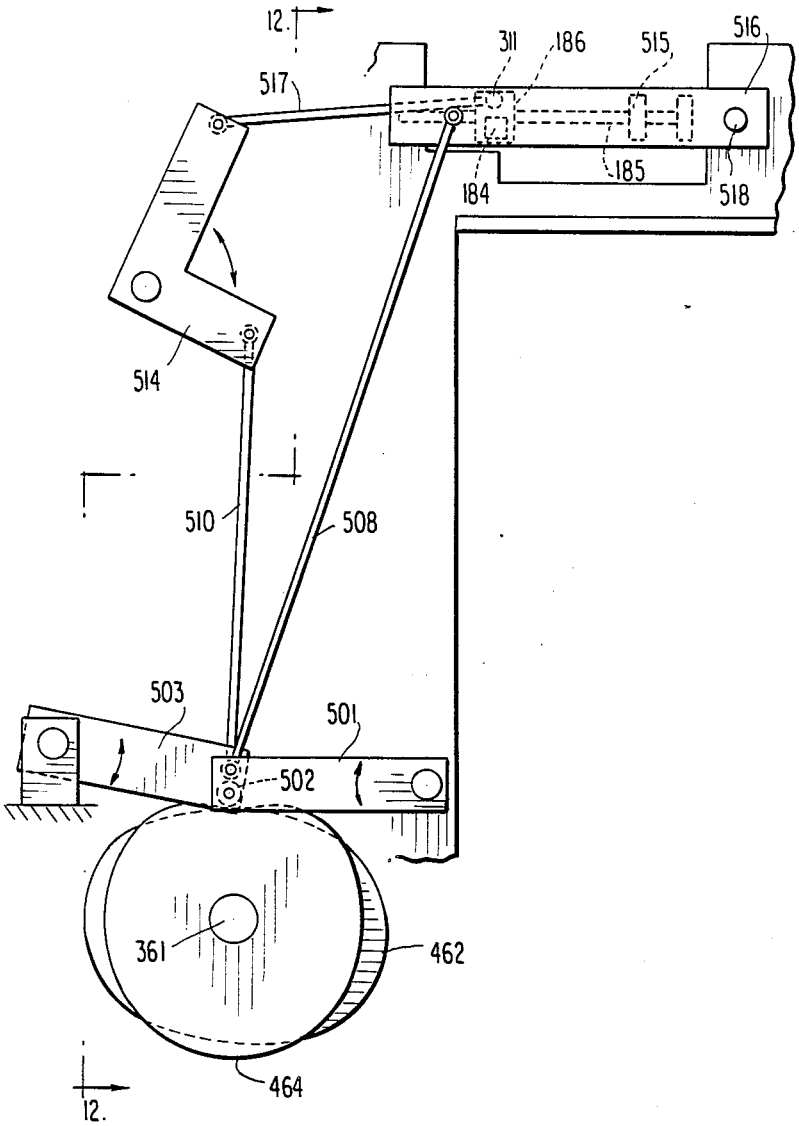
FIG. 11 is a simplified side view similar to FIG. 8, but showing the driving mechanism for the separator member of the invention.
Figure 12:
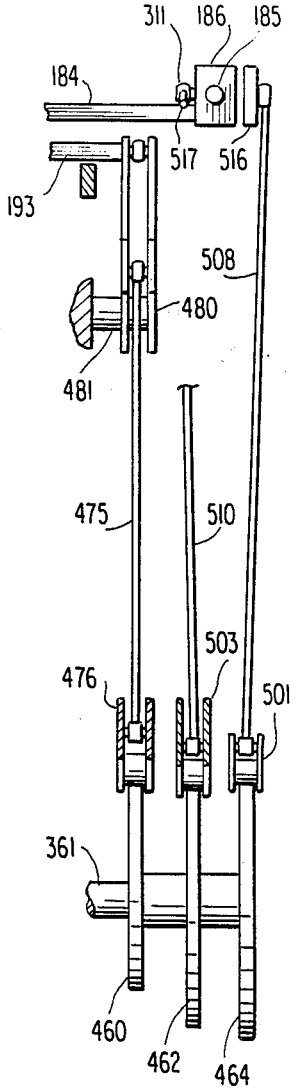
FIG. 12 is a front view of parts of the driving mechanisms illustrated in FIGS. 8 and 11, taken along lines 12—12 in FIGS. 8 and 11.

FIGS. 11 and 12 illustrates the cam control system for the separator member 180. As shown in FIG. 11, cams 462, 464 are commonly driven by shaft 361. Cam 464 is associated with a follower 502 mounted on lever 501. Cam 462 is associated with a follower (not shown) mounted on lever 503. Lever 501 is connected at one end to a link 508, which is connected at its other end to the separator support lever 516, which rotates about pivot 518. Lever 503 is connected to one end of a link 510, the other end of which is connected to one end of a bell crank 514. The other end of the bell crank is connected to one end of a link or links 517, which are in turn connected at their other ends to the slide blocks 186 via connectors 311 (FIG. 5). Slide blocks 186 thus slide on shafts 185. Supports such as 515 (FIG. 7) couple the levers 516 to the shafts 185.

With the construction shown in FIG. 11, the vertical movement of the separator 180 is controlled via cam 464, link 508, and pivotable lever or levers 516. Movement of the separator in the horizontal direction or along slide shaft 185 is controlled via the cam 462, links 510, 517 and bell crank 514. The cam profiles of cams 462, 464 are determined so as to achieve the locus of separator motion shown in FIG. 5. In particular, the cams are designed such that the horizontal motion of the separator is substantially uniform, but such that the vertical component of the separator motion exhibits a rapid increase at the beginning of each separator stroke, i.e., at the time when the separator tongue descends and is inserted between two adjacent articles forwarded by the flipper mechanism. As noted above, FIG. 2 illustrates the position of the separator tongue 182 in a time-differentiated manner such that the time between adjacent illustrated positions is uniform in the figure.

FIG. 12 is a view taken along lines 12—12 of both FIGS. 8 and 11 and showing all three cam members 460, 462, 464. As indicated, these cams are provided conjointly on shaft 361. Link elements 508, 510, 517 and 475 correspond to the like elements in FIGS. 8 and 11. Links 510, 517 are shown partly cut away according to the section indicated at lines 12—12 in FIG. 11.

Although the invention has been shown and described in connection with a single stream of incoming articles, it will be apparent to one of skill in the art that the operable elements of the invention may be duplicated so as to accept plural parallel streams of such articles. In such a case, a plurality of flipper mechanisms, separator tongues and backup members may be respectively disposed on the shafts 162, 184 and 193, so as to handle any number of incoming articles streams without substantial duplication of hardware. In addition, the invention is not limited to the specific articles conveyed, and may be used with any substantially thin and flat article requiring assimilation into groups prior to packaging.

I claim:

1. An automatic tray packer, comprising:

first means for delivering at least one serial stream of articles to be packaged while said articles are positioned substantially in a first plane;

means for decelerating said articles at the output of said first means;

means for receiving said serial stream of articles and for causing said articles to be sequentially rotated into a second plane transverse to said first plane, and for stacking said articles;

separator means for dividing said articles, as they are being stacked, into a group by defining an upstream end of said group; for transporting each group to a discharge location; and, during transport of said group, for supporting articles stacked by said receiving means and which will form the next subsequent group by defining a downstream end of said next subsequent group; and means for discharging each group into package means, wherein said separator means comprises a separator tongue member controlled to follow a locus of motion describing an endless path, and backup means controlled to follow a locus of motion describing a linear reciprocating path, wherein the locus of motion of said separator tongue member substantially intersects the locus of motion of said backup means at a changeover location located substantially at one extreme of the locus of motion of said backup means, and wherein said tray packer further includes means for controlling the loci of motion followed by said backup means and said separator means, said motion control means being adapted for moving said separator means from said changeover location to a position for defining the upstream end of said group and the downstream end of said next subsequent group, and for moving said backup means such that it is positioned for supporting said stacked articles which will form said group at said changeover location substantially simultaneously with movement of said separator means from said changeover location, said backup means thereafter supporting said articles and defining the downstream end of said group until the discharge of said articles.

2. An automatic tray packer as claimed in claim 1, wherein said delivering means comprises a conveyor run.

3. An automatic tray packer as claimed in claim 1, wherein said decelerating means comprises a nose roller situated at the output of said delivering means, and rotating at a surface speed substantially lower than a surface speed of said delivering means.

4. An automatic tray packer as claimed in claim 1, wherein said receiving means comprises:

slide means arranged at the exti of said decelerating means and defining a slide surface for said articles, said slide surface being oriented at a steep angle of descent from a plane of said delivering means;

abutment means arranged below said slide surface for halting the vertical descent of said articles; and reciprocating flipper means for engaging each said article in a sequential manner and for forwarding said articles so as to form a stack of said articles.

5. An automatic tray packer as claimed in claim 4, wherein said articles as carried by said delivering means are in a substantially horizontal orientation, and wherein said articles as stacked by said flipper means are in a substantially vertical orientation.

6. An automatic tray packer as claimed in claim 5, wherein said flipper means has a range of reciprocating rotation between approximately 15° short of vertical and 15° past vertical.

7. An automatic tray packer as claimed in claim 4, wherein said flipper means comprises a bifurcated engagement member for engaging each successive article at a backside thereof and for advancing each said article past a predetermined location on said abutment means.

8. An automatic tray packer as claimed in claim 7, wherein said motion control means is adapted for moving said separator means into position for defining said upstream end of said group in contact with an upstream most article in said group and said downstream end of said next subsequent group, in which a next article being flipped will be a downstream most article, prior to contact between said upstream most article and said downstream most article.

9. An automatic tray packer as claimed in claim 1, further comprising backup means for supporting said articles from a time extending at least from the time each group is defined by said separator means until a time at which this group is discharged.

10. An automatic tray packer as claimed in claim 1, further comprising means for controlling the loci of motion followed by said backup means and said separator means.

11. An automatic tray packer as claimed in claim 1, wherein said discharging means comprises a trap-door mechanism, which, when actuated, permits said group of articles to drop under its own weight into said package means.

12. An automatic tray packer, comprising:

first means for delivering at least one serial stream of articles to be packaged while said articles are positioned substantially in a first plane;

means for decelerating said articles at the output of said first means;

means for receiving said serial stream of articles and for causing said articles to be sequentially rotated into a second plane transverse to said first plane, and for stacking said articles;

separator means for dividing said articles, as they are being stacked, into a group; for transporting each group to a discharge location; and, during transport of said group, for supporting articles stacked by said receiving means and which will form the next subsequent group; and means for discharging each group into package means, wherein said separator means comprises a separator tongue member controlled to follow a locus of motion describing an endless path.

13. An automatic tray packer, comprising:

first means for delivering at least one serial stream of articles to be packaged while said articles are positioned substantially in a first plane;

means for decelerating said articles at the output of said first means;

means for receiving said serial stream of articles and for causing said articles to be sequentially rotated into a second plane transverse to said first plane, and for stacking said articles;

separator means for dividing said articles, as they are being stacked, into a group; for transporting each group to a discharge location; and, during transport of said group, for supporting articles stacked by said receiving means and which will form the next subsequent group;

means for discharging each group into package means, wherein said separator means comprises a separator tongue member controlled to follow a locus of motion describing an endless path, backup means controlled to follow a locus of motion describing a linear reciprocating path, and wherein the locus of motion of said separator tongue member substantially intersects the locus of motion of said backup means at a changeover location located substantially at one extreme of the locus of motion of said backup means; and means for controlling the loci of motion followed by said backup means and said separator means, wherein said motion control means comprises first cam means for defining the motion of said backup means, and second and third cam means for defining the motion of said separator means.

14. An automatic tray packer as claimed in claim 13, wherein said receiving means include reciprocating flipper means for engaging each said article in a sequential manner and for forwarding said articles so as to form a stack of said articles.

15. An automatic tray packer as claimed in claim 14, wherein said delivering means comprises conveyor means, and further comprising at least one rotary indexer means associated with said conveyor means for spacing said articles uniformly on said conveyor means.

16. An automatic tray packer as claimed in claim 15, further comprising drive train means powered by a single motive source for driving said motion control means, said decelerating means, said indexer means and said flipper means.

17. An automatic tray packer as claimed in claim 13, wherein said control means further comprises follower means engaging said cam means, and link means extending between said follower means and said separator means and said backup means, respectively.

18. An automatic tray packer as claimed in claim 17, wherein said link means for said separator means includes lever arm means for slideably supporting said separator means and for lifting said separator means in response to the characteristic of said second cam means, and means operating in response to said third cam means for sliding said separator means on said lever arm means.

19. An automatic tray packer as claimed in claim 13, wherein at least one of said second and third cam means has a characteristic enabling said separator means to rapidly descend from a position above said articles to a position where said tongue member is inserted between two adjacent articles successively advanced by said flipper means.

20. An automatic tray packer, comprising:

first means for delivering at least one serial stream of articles to be packaged while said articles are positioned substantially in a first plane;

means for decelerating said articles at the output of said first means;

means for receiving said serial stream of articles and for causing said articles to be sequentially rotated into a second plane transverse to said first plane, and for stacking said articles;

separator means for dividing said articles, as they are being stacked, into a group; for transporting each group to a discharge location; and, during transport of said group, for supporting articles stacked by said receiving means and which will form the next subsequent group; and means for discharging each group into package means, wherein said receiving means comprises:

slide means arranged at the exit of said decelerating means and defining a slide surface for said articles, said slide surface being oriented at a steep angle of descent from a plane of said delivering means;

abutment means arranged below said slide surface for halting the vertical descent of said articles; and reciprocating flipper means for engaging each said article in a sequential manner and for forwarding said articles so as to form a stack of said articles, wherein said flipper means comprises a bifurcated engagement member for advancing each successive article at a backside thereof and for advancing each said article past a predetermined location on said abutment means, and wherein said predetermined location comprises a downward step formed in said abutment means.

* * * * *